US009960534B2

(12) United States Patent
Nagae et al.

(10) Patent No.: US 9,960,534 B2
(45) Date of Patent: May 1, 2018

(54) CONNECTOR

(71) Applicants: FUJIKURA LTD., Tokyo (JP); DDK LTD., Tokyo (JP)

(72) Inventors: Norifumi Nagae, Tokyo (JP); Issey Miyake, Tokyo (JP); Masayuki Suzuki, Tokyo (JP); Hirokazu Takahashi, Tokyo (JP); Yuuki Nakano, Tokyo (JP)

(73) Assignees: FUJIKURA LTD., Tokyo (JP); DDK LTD., Tokyo (JP)

( * ) Notice: Subject to any disclaimer, the term of this patent is extended or adjusted under 35 U.S.C. 154(b) by 0 days. days.

(21) Appl. No.: 15/634,810

(22) Filed: Jun. 27, 2017

(65) Prior Publication Data

US 2017/0373436 A1 Dec. 28, 2017

(30) Foreign Application Priority Data

Jun. 27, 2016 (JP) ..... 2016-126192

(51) Int. Cl.

| | |
|---|---|
| ***H01R 13/627*** | (2006.01) |
| ***H01R 12/70*** | (2011.01) |
| ***H01R 12/78*** | (2011.01) |
| ***H01R 13/6581*** | (2011.01) |

(52) U.S. Cl.

CPC ..... *H01R 13/6272* (2013.01); *H01R 12/7082* (2013.01); *H01R 12/78* (2013.01); *H01R 13/6581* (2013.01)

(58) Field of Classification Search

CPC . H01R 13/6272; H01R 12/7082; H01R 12/78

USPC ..... 439/357

See application file for complete search history.

(56) References Cited

U.S. PATENT DOCUMENTS

| | | | | |
|---|---|---|---|---|
| 7,108,552 | B2 * | 9/2006 | Niitsu | H01R 12/725 439/607.35 |
| 9,209,538 | B2 * | 12/2015 | Yoshida | H01R 12/714 |
| 9,400,899 | B2 * | 7/2016 | Seo | G06K 7/0052 |
| 9,401,568 | B1 * | 7/2016 | Masuda | H01R 13/6581 |
| 2008/0254657 | A1 * | 10/2008 | Sun | H01R 13/52 439/152 |
| 2009/0124133 | A1 * | 5/2009 | Tsai | H01R 43/16 439/660 |
| 2009/0163081 | A1 * | 6/2009 | Zhang | H01R 27/00 439/630 |
| 2009/0275239 | A1 * | 11/2009 | Zhang | H01R 27/00 439/630 |

(Continued)

FOREIGN PATENT DOCUMENTS

| | | |
|---|---|---|
| JP | 2004-071160 A | 3/2004 |
| JP | 2010-205576 A | 9/2010 |

*Primary Examiner* — Alexander Gilman

(74) *Attorney, Agent, or Firm* — Procopio, Cory, Hargreaves & Savitch LLP

(57) ABSTRACT

A connector includes a required number of contacts, an electrical insulation housing and a metallic shell. A tab is formed in the connector. A pressure receiving portion of the tab is pushed by a pushing portion of the shell to move the pressure receiving portion toward a mounting face of a substrate for applying a force in the insertion of FPC but not applying a force to the tab in the detaching thereof, whereby an engaging portion of the tab is moved in a direction opposing to the mounting face of the substrate to unfasten the engaging portion from an locking portion of the FPC.

11 Claims, 8 Drawing Sheets

(56) References Cited

U.S. PATENT DOCUMENTS

| | | | | |
|---|---|---|---|---|
| 2010/0291785 | A1* | 11/2010 | Chien | G06K 7/0021<br>439/329 |
| 2011/0003496 | A1* | 1/2011 | Hu | G06K 7/0021<br>439/159 |
| 2011/0318963 | A1* | 12/2011 | Kamoya | H01R 12/79<br>439/607.35 |

* cited by examiner

CONNECTOR

CROSS-REFERENCE TO RELATED APPLICATIONS

This application claims priority to Japanese Patent Application No 2016-126192, filed Jun. 27, 2016, the contents of which are incorporated herein by reference.

TECHNICAL FIELD

This invention relates to a connector used in electronic devices such as mobile phones, notebook computers, digital cameras and the like, and more particularly to a structure of a connector which is capable of connecting only by inserting a flexible printed-circuit board (hereinafter abbreviated as "FPC") or a flexible flat cable (hereinafter abbreviated as "FFC") without increasing the part number, causing breakage in strength and damaging workability, and prevents FPC or FFC from unfastening and can be easily detached in the detaching and can reduce a connector mounting space.

RELATED ART

In JP-A-2004-71160 (Patent Document 1), connection is attained by rotating a slider after the insertion of FPC or FFC to turn a pressing portion to thereby push a contacting part of a contact onto FPC or FFC.

Also, JP-A-2010-205576 (Patent Document 2) is same in the basic concept as in Patent Document 1 and provides a gland by using a shell and contacting the shell with the contact for enhancing a shielding property.

DISCLOSURE OF THE INVENTION

Task to Be Solved By the Invention

In markets, downsizing/narrowing of the connector is further advanced, whereby a working space (for example, operating region of a slider) is also decreased. With the advance of the downsizing/narrowing of the connector is thinned a part (housing or slider) leading to decrease the strength, which may damage the part and decrease the strength of the connector as a whole.

Also, the thinning causes problems in the formability, which can be dealt by using a material having a good fluidity or many gates. In this method, however, weld may be generated to bring about the decrease of the strength.

In the structure as disclosed in Patent Document 1 or 2, the connection between the contact and FPC or FFC cannot be attained unless the slider is rotated, and hence the operation of the slider becomes troublesome. To this end, it is desired to develop a connector having a structure that connection can be attained only by inserting FPC or FFC from a viewpoint of the working space and the unfastening of FPC or FFC can be prevented.

Furthermore, it is demanded to have a structure of simply removing FPC or FFC in the detaching thereof.

In addition, it is required to be excellent in the shielding property and narrow the space for mounting the connector.

The invention is made in view of the above problems of the conventional techniques and is to provide a connector having a simple structure which is excellent in the shielding property without increasing the number of parts and causing damages in strength and damaging the operability and is capable of attaining connection only by inserting FPC or FFC and simply removing in the detaching and narrowing the space for mounting the connector.

Solution for Task

The invention is made for achieving the above object and is a connector structure of the following summary and constructions:

(1) A connector mounted onto a substrate and inserting a connection body with a locking portion from a direction substantially parallel to a mounting face of the substrate, which comprises a required number of contacts each having a contacting portion contacting with the connection body and a connecting portion mounted onto the substrate;

an electrical insulation housing for supporting the contacts and having an insertion port inserting the connection body;

a metallic shell covering the housing; and a lock member engaging with the locking portion, characterized in that the lock member comprises a first piece provided on an end side thereof with an engaging portion located at a side of the connection body opposite to the mounting face of the substrate and engaged with the locking portion and on the other end side with a pressure receiving portion pressed by the shell, a second piece provided on an end side or other end side with an another connecting portion mounted onto the substrate, and a connecting portion connecting an approximately middle portion of the first piece to an end or the other end of the second piece; and the shell comprises a pushing portion arranged at an opposite side of the insertion port and at a position of the shell corresponding to the pressure receiving portion, and a first displacement means facilitating an elastic deformation of the pressure receiving portion.

(2) A connector described in the item (1), wherein the first displacement means is constructed with two slits disposed in the vicinity of both ends in an array pitch direction of the required number of contacts.

(3) A connector described in the item (1) or (2), wherein the pressure receiving portion is moved toward a side of the mounting face of the substrate by pushing the pressure receiving portion of the lock member with the pushing portion of the shell in the detaching of the connection body, whereby the engaging portion of the lock member is moved toward a side opposite to the mounting face of the substrate to detach the engaging portion from the locking portion.

(4) A connector described in any one of the items (1) to (3), which further comprises a second displacement means facilitating the elastic deformation of the pushing portion.

(5) A connector described in the item (2), wherein the slit is opened in a direction opposite to the insertion port.

(6) A connector described in the item (4), wherein the second displacement means is constructed with an elongated hole extending in the array pitch direction of the required number of contacts.

(7) A connector described in any one of the items (1) to (6), wherein the pushing portion of the shell is provided with a reinforcing portion.

(8) A connector described in the item (7), wherein a thickness of the pushing portion inclusive of the reinforcing portion is 0.12-0.20 mm.

(9) A connector described in any one of the items (1) to (8), wherein the another connecting portion of the lock member is disposed at a side of the insertion port and the lock member is provided at a side opposing to the pressure receiving portion with an extending portion extended from the connection portion.

(10) A connector described in any one of the items (1) to (9), wherein the housing is provided with a groove or a hole at a side opposing to the mounting face of the substrate, in the vicinity of both ends in the array pitch direction and in a position corresponding to the engaging portion of the lock member.

(11) A connector described in any one of the items (1) to (10), wherein the contact includes one or both of a first contact segment that a first contacting portion as the contacting portion is disposed at a side of the insertion port and in a position contacting with a side of the connection body opposing to the mounting face of the substrate or a side of the mounting face of the substrate and a first connecting portion as the connecting portion is disposed at a side opposing to the insertion port or at a side of the insertion port and a second contact segment that a second contacting portion as the contacting portion is disposed at a side of the insertion port and in a position contacting with a side of the connection body at a side opposing to the mounting face of the substrate or at a side of the mounting face of the substrate and a second connecting portion as the connecting portion is disposed at a side of the insertion port or at a side opposing to the insertion port, and the first contact segment and the second contact segment are alternately arranged while changing insertion directions into the housing.

Effect of the Invention

According to the invention, the connector has a simple structure and the following effects:

(1) it is rigid and excellent in the strength;

(2) connection can be attained only by inserting FPC or FFC without increasing the number of parts;

(3) unfastening is not caused simply because the lock member is engaged with FPC or FFC;

(4) the shielding property is improved with the shell;

(5) the detaching of FPC or FFC is easy because the engaging portion of the lock member is easily removed from FPC or FFC by pushing the shell to press the pressure receiving portion of the lock member; and (6) it is not necessary to rotate the slider and the space for rotation is not required, so that the workability is excellent and the space for mounting the connector can be made narrow.

BEST EMBODIMENT FOR CARRYING OUT THE INVENTION

The invention is a connector mounted onto a substrate and inserting a connection body provided at an end portion with a locking portion such as a flexible printed circuit (FPC), a flexible flat cable (FFC) or the like from a direction substantially parallel to a mounting face of the substrate, which comprises a required number of contacts each having a contacting portion contacting with the end portion of the connection body and a connecting portion mounted onto the substrate, an electrical insulation housing for supporting the contacts and having an insertion port inserting the connection body, a metallic shell covering the housing; and a lock member engaging with the locking portion, wherein the lock member comprises a first piece provided on an end side thereof with an engaging portion located at a side of the connection body opposite to the mounting face of the substrate and engaged with the locking portion and on the other end side with a pressure receiving portion pressed by the shell, a second piece provided on an end side or other end side with a connecting portion mounted onto the substrate, and a connection portion connecting an approximately middle portion of the first piece to an end or the other end of the second piece; and the shell comprises a pushing portion arranged at an opposite side of the insertion port and at a position of the shell corresponding to the pressure receiving portion, and a first displacement means facilitating an elastic deformation of the pressure receiving portion.

That is, in order that in the connector according to the invention, force is applied in the insertion of the connection body but force is not applied to the lock member in the detaching thereof, the pressure receiving portion is moved toward the side of the mounting face of the substrate by pushing the pressure receiving portion of the lock member with the pushing portion of the shell and the engaging portion of the lock member is moved toward a side opposing to the mounting face of the substrate, whereby the engaging portion is unfastened from the locking portion.

Moreover, the contacting portion of the contact is arranged at a side of the insertion port in a position contacting with the side of the mounting face of the substrate or the side opposing to the mounting face, while the connecting portion thereof may be arranged at the side of the insertion port or at the side opposing to the insertion port.

Further, the housing may be provided with insertion grooves and insertion holes extended from the side of the insertion port to the side opposite to the insertion port and supporting the required number of contacts and tabs as a lock member.

The first displacement means may be constructed with two slits defining both side edges of the pushing portion. The pushing portion may have a thickness pushing the pressure receiving portion of the lock member.

Figure 8A:
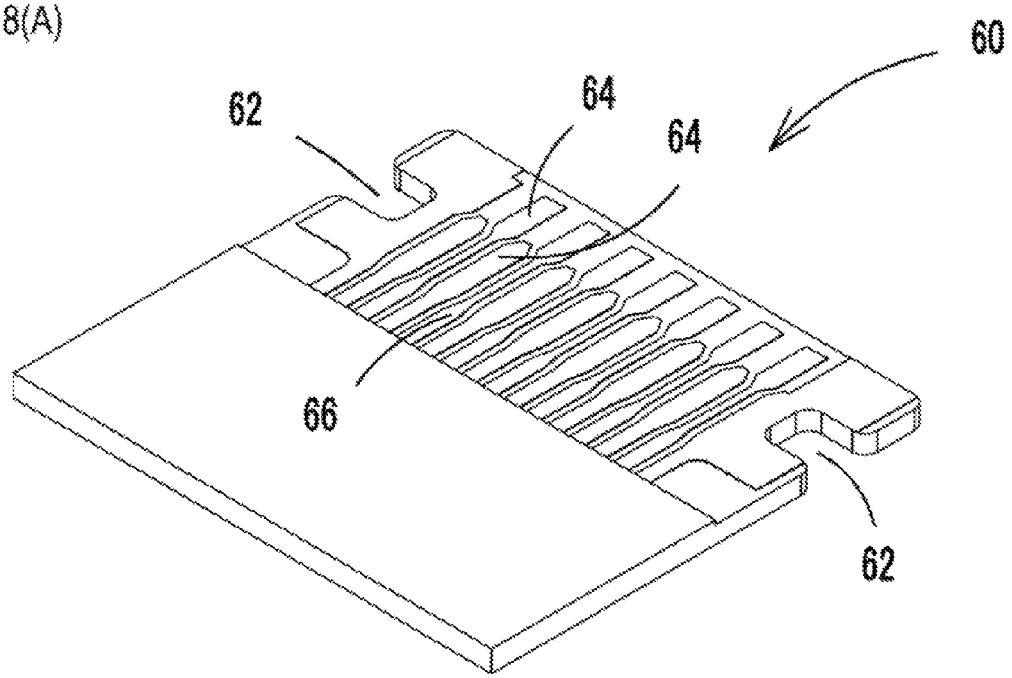
FIG. 8(A) is a perspective view of FPC viewing from an upper direction opposing to an insertion port for a connection body.
Figure 8B:
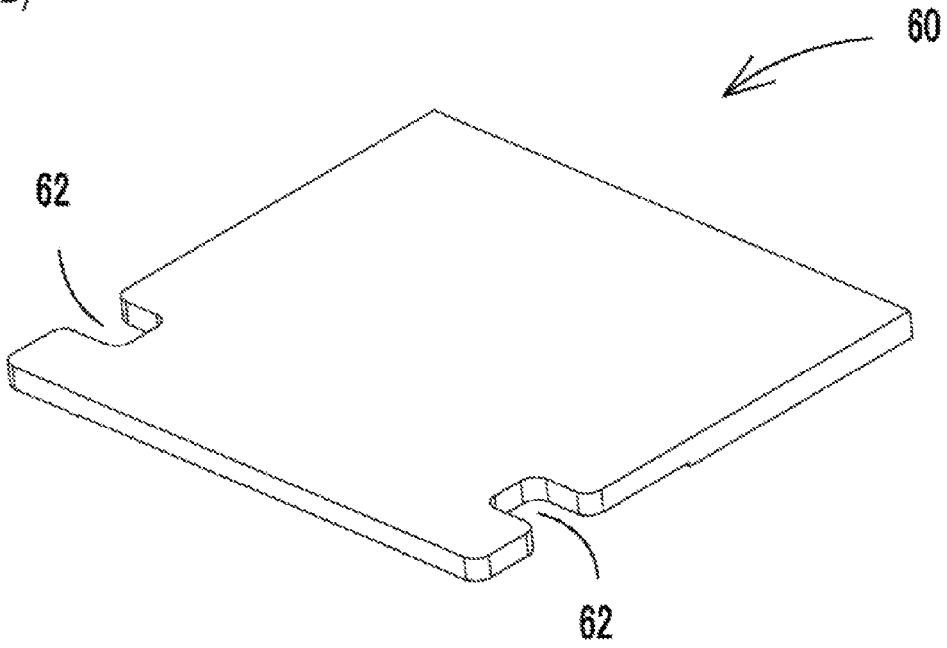
FIG. 8(B) is a perspective view of FPC viewing from a lower direction opposing to an insertion port for a connection body.

The connection body will be described prior to the description of the connector 10 as an embodiment of the invention. As the connection body may be included a flexible printed circuit (FPC), a flexible flat cable (FFC) and so on. Here, FPC 60 shown in FIG. 8 is described as an example of the connection body. The FPC 60 is provided with lands 64 contacting with first contacting portion 121 of a first contact segment 12 and a second contacting portion 141 of a second contact segment 14 as two different contacts, a pattern 66 connecting from the land 64 to a circuit, and a locking portion 62 engaging with an engaging portion 203 of a tab 20 as a lock member. As shown in FIG. 8, the lands 64 of the FPC 60 are arranged in a zigzag form. The locking portion 62 may take any form as long as it can be engaged with an engaging portion 203 of the tab 20, but is a notch having an approximately U-shaped edge form in this example. Moreover, the locking portion may be a through-hole or a retaining hole.

Next, the connector 10 will be described with reference to FIGS. 1 to 7. The connector 10 is provided with contacts (first contact segments 12 and second contact segments 14) having contacting portions (first contacting portions 121 and second contacting portions 141) at least contacting with the connection body (FPC 60) and connection portions (first connecting portions 122 and second connecting portions 142) connecting to a substrate, a housing 16 keeping these contacts (first contact segments 12 and second contact segments 14), a tab 20 and a shell 30 covering the housing 16 and acting to the tab 20.

Firstly, the shell 30 will be described. The shell 30 is made from a metal and formed by a well-known technique such as pressing, cutting or the like. As a material of the shell 30 may be mentioned beryllium copper alloy, phosphor bronze, Corson alloy and the other alloys because it is required to have spring property, electrical conductivity, dimensional stability and so on.

The shell 30 has an approximately U-shaped form viewing from a direction of inserting the connection body and is composed mainly of a main body 301 and fixed pieces 302. The main body 301 is provided with at least a pushing portion 304 acting (pushing) to a pressure receiving portion 204 of the tab 20 in a position corresponding to the pressure receiving portion 204, and a first displacement means (slits 303) for providing elasticity to the pushing portion 304 in the vicinity of both ends in a direction of array pitches of the required number of contacts (12, 14) (for displacing the pushing portion 304). The first displacement means has a slit form in this example. The slit 303 as the first displacement means is opened in a direction opposing to an insertion port 5. Further, the pushing portion 304 is formed so as to have such a thickness that the pressure receiving portion 204 of the tab 20 is pushed between the two slits 303, 303. In the fixed piece 302 is formed an arrowhead, which is kept by press fitting. If the shell 30 can be kept in the housing 16, the keeping may be attained by any method such as welding, hooking or the like.

The pushing portion 304 is a portion of pushing the pressure receiving portion 204 of the tab 20 in the detaching of the FPC 60. The size (thickness) and shape of the pushing portion 304 are properly designed by considering the function, workability, strength, downsizing of the connector and so on as long as the pressure receiving portion 204 of the tab 20 can be pushed.

The slit 303 as the first displacement means is a portion for providing an elasticity so as to easily displace the pushing portion 304 in the detaching of the FPC 60. The size and shape of the slit 303 are properly designed by considering the elasticity, the downsizing of the connector, the strength, workability and so on as long as the pressure receiving portion 204 of the tab 20 can be displaced by pushing.

Further, a second displacement means is disposed at a side of an insertion port 5 and between the slits 303 of the main body 301 for providing an elasticity to the pushing portion 304 (for displacing the pushing portion 304). In this example, the second displacement means is a hole 305. The hole 305 is also a portion for providing an elasticity to the pushing portion 304 likewise the slit 303. The hole 305 as the second displacement means is desirable to be formed for supplementing the elasticity of the slit 303. The hole 305 is formed in an elongated shape between the slits 303 (see FIG. 4). The size and shape of the hole 305 may be anything as long as the elasticity of the slit 303 can be supplemented. Also, it may be a plurality of disconnected holes or a groove. The hole is pierced in this example, but may be a retaining hole (not shown).

Furthermore, the pushing portion 304 is provided with a reinforcing portion 306. The reinforcing portion 306 is a portion gaining thickness and strength for surely pushing the pressure receiving portion 204 of the tab 20. Since the shell 30 has a thickness of 0.06-0.10 mm, it is desirable to provide the reinforcing portion 306 for ensuring the secure pushing. In this example, the reinforcing portion 306 is integrally united with the shell 30 by folding the pushing portion 304. As long as the pressure receiving portion 204 of the tab 20 can be pushed, the reinforcing portion 306 can be formed by joining a separate material through welding, press fitting or the like.

The thickness including the pushing portion 304 and the reinforcing portion 306 is desirable to be 0.12-0.20 mm. When the thickness is less than 0.12 mm, the pressure receiving portion 204 of the tab 20 cannot be pushed sufficiently, and loading becomes large to bring about breakage. while when it exceeds 0.20 mm, the elasticity cannot be obtained to bring about the breakage because the downsizing of the connector cannot be attained.

On both sides of the fixed piece 302 in a short hand direction (in a direction of inserting FPC 60) are provided shielding pieces of an approximately L-shaped form. They are portions covering a side face of the housing 16 to more enhance the shielding property.

The tab 20 as a lock member will be described below. The tab 20 is made from a metal and prepared by a well-known technique such as pressing. As a material of the tab 20 can be mentioned a brass, beryllium copper alloy, phosphor brass and so on because it is required to have a spring property, formability and the like.

Figure 1A:
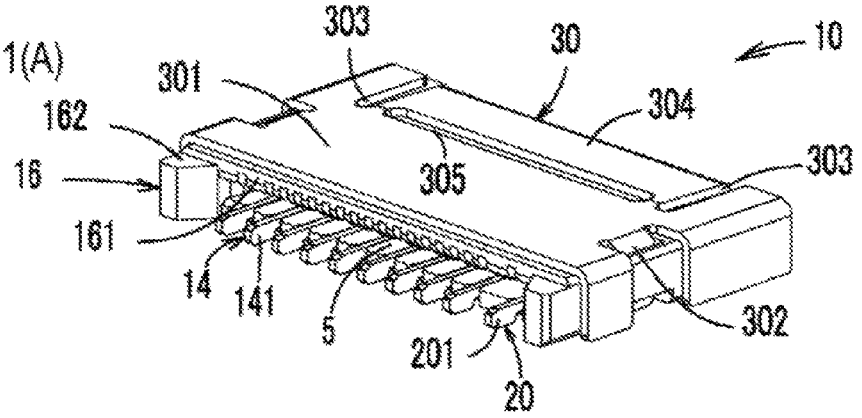
FIG. 1(A) is a perspective view of a connector as an embodiment of the invention viewing from an insertion port for a connection body.
Figure 1B:
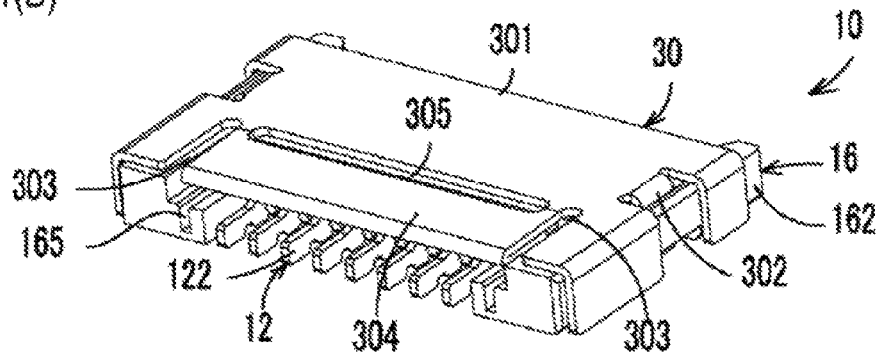
FIG. 1(B) is a perspective view of a connector as an embodiment of the invention viewing from a direction opposing to an insertion port for a connection body.
Figure 1C:
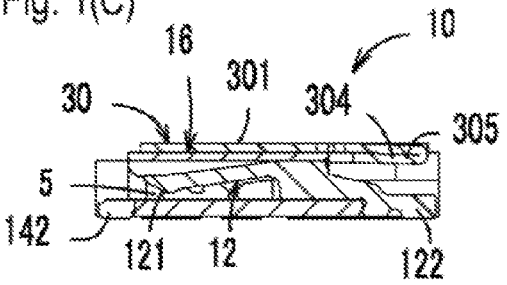
FIG. 1(C) is a section view of a connector as an embodiment of the invention taken at a center of a first contact segment.
Figure 1D:
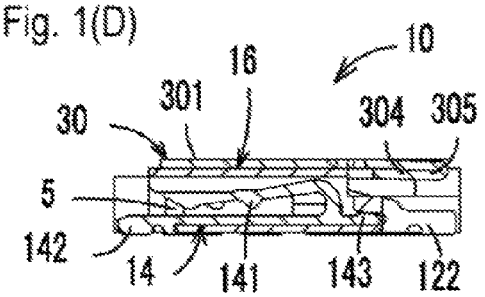
FIG. 1(D) is a section view of a connector as an embodiment of the invention taken at a center of a second contact segment.
Figure 1E:
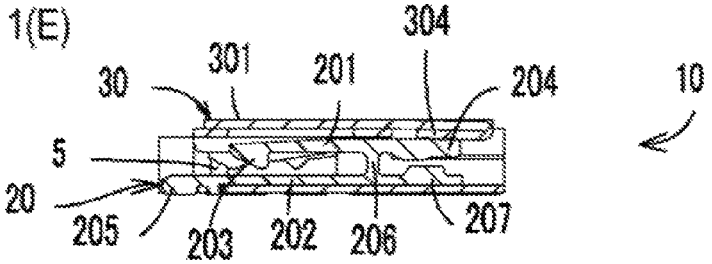
FIG. 1(E) is a section view of a connector as an embodiment of the invention taken at a center of a tab as a lock member.
Figure 2A:
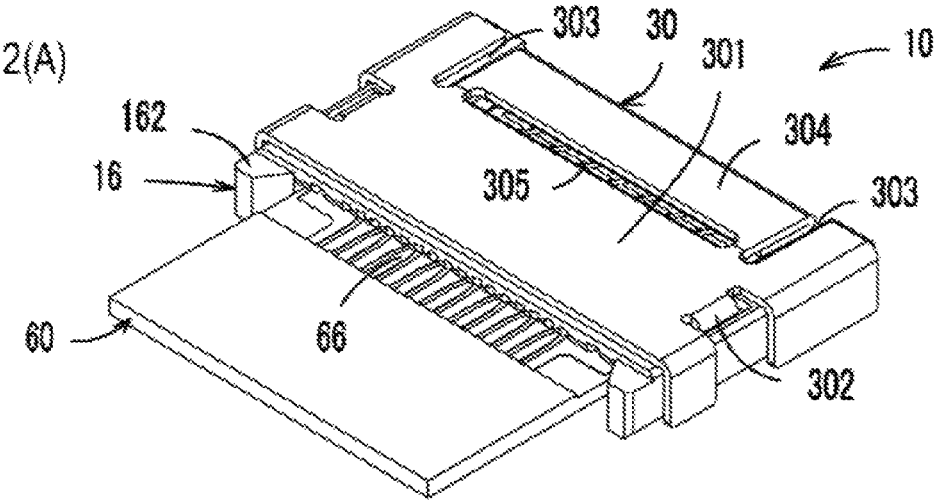
FIG. 2(A) is a perspective view of a connector as an embodiment of the invention at a state of inserting a connection body viewing from an insertion port for the connection body.
Figure 2B:
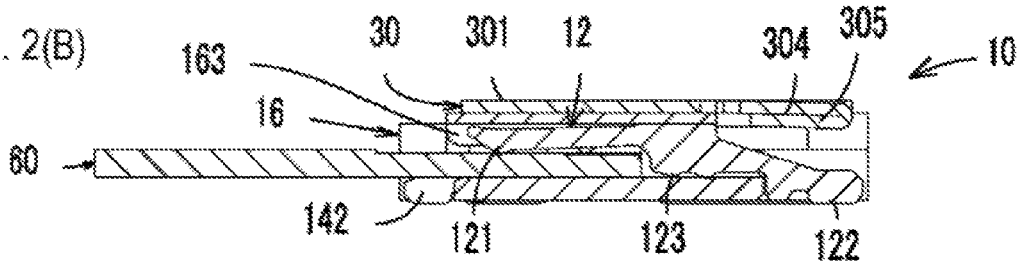
FIG. 2(B) is a section view of a connector as an embodiment of the invention at a state of inserting a connection body taken at a center of a first contact segment.
Figure 2C:
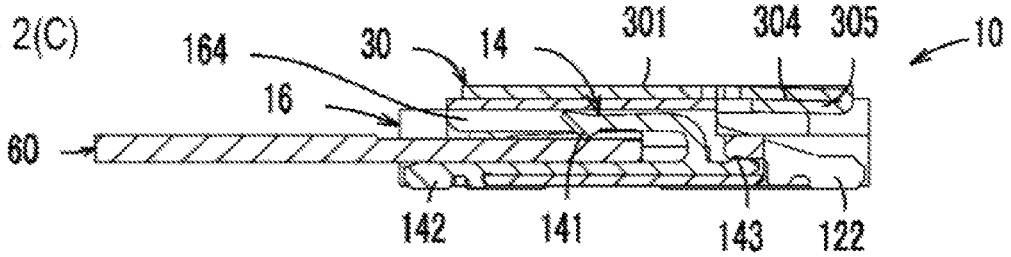
FIG. 2(C) is a section view of a connector an an embodiment of the invention at a state of inserting a connection body taken at a center of a second contact segment.
Figure 2D:
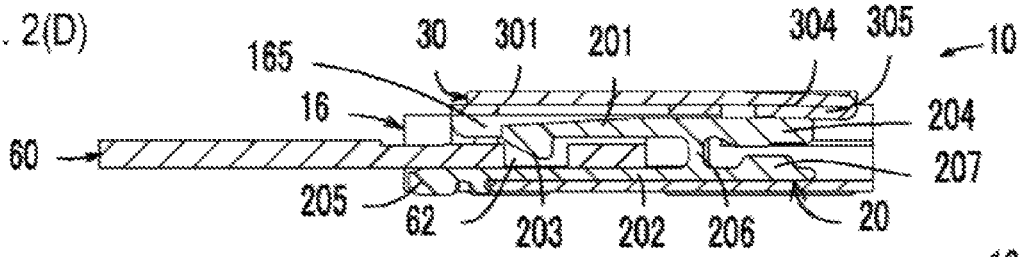
FIG. 2(D) is a section view of a connector as an embodiment of the invention at a state of inserting a connection body taken at a center of a tab as a lock member.
Figure 2E:
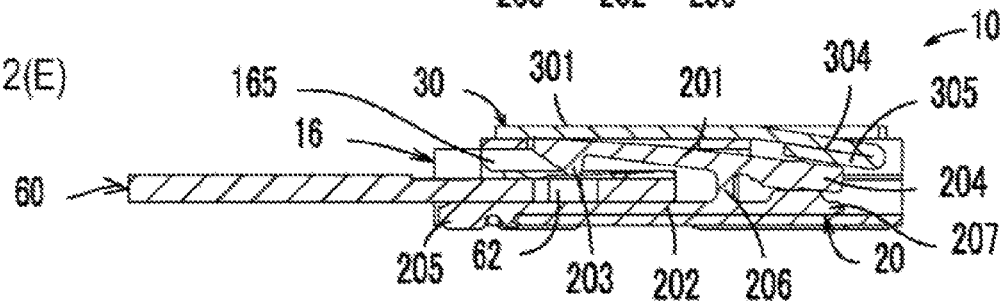
FIG. 2(E) is a section view of a connector as an embodiment of the invention at a state of inserting a connection body taken at a center of a tab as a lock member in the releasing of an engaging portion of the tab.
Figure 3A:
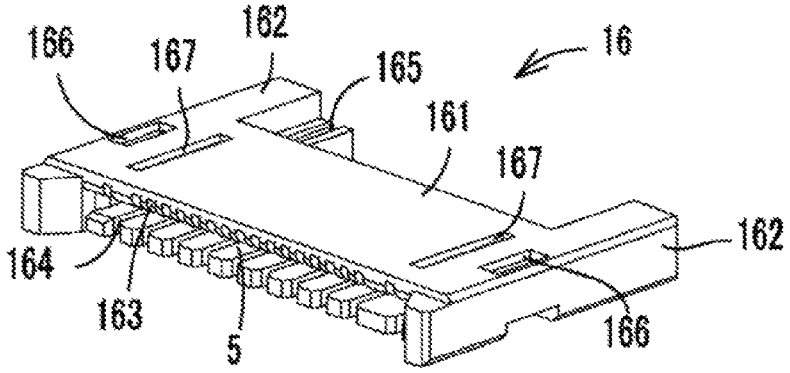
FIG. 3(A) is a perspective view of a housing viewing from an insertion port for a connection body.
Figure 3B:
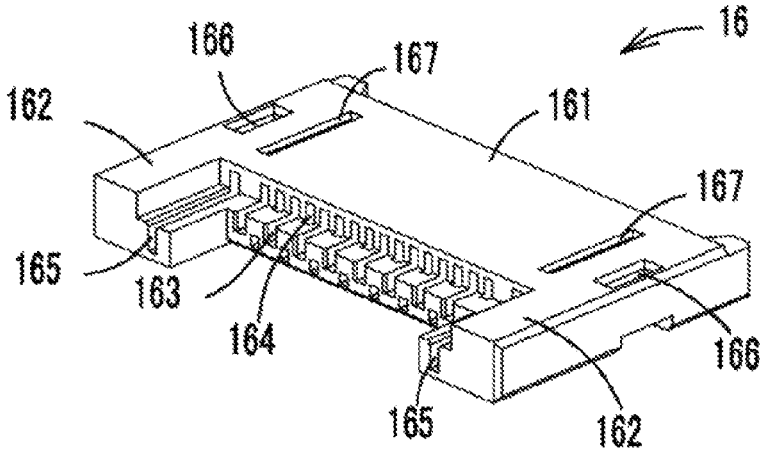
FIG. 3(B) is a perspective view of a housing viewing from a direction opposing to an insertion port for a connection body.
Figure 3C:
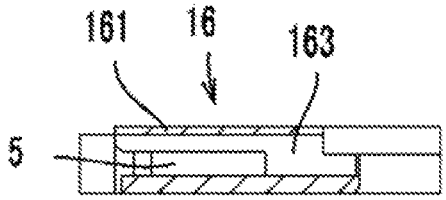
FIG. 3(C) is a section view of a housing taken at a center of a first contact segment.
Figure 3D:
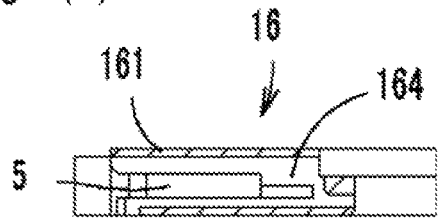
FIG. 3(D) is a section view of a housing taken at a center of a second contact segment.
Figure 3E:
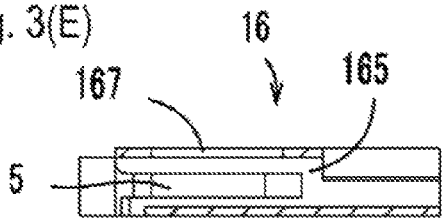
FIG. 3(E) is a section view of a housing taken at a center of a tab as a lock member.
Figure 4A:
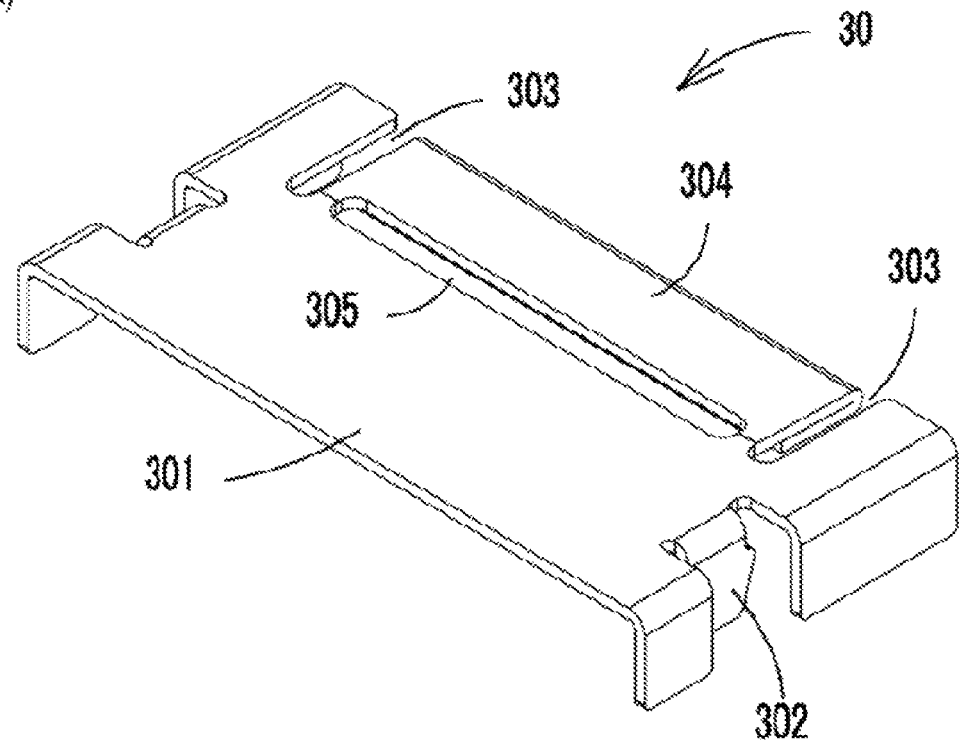
FIG. 4(A) is a perspective view of a shell as an embodiment of the invention viewing from an upper direction of an insertion port for a connection body.
Figure 4B:
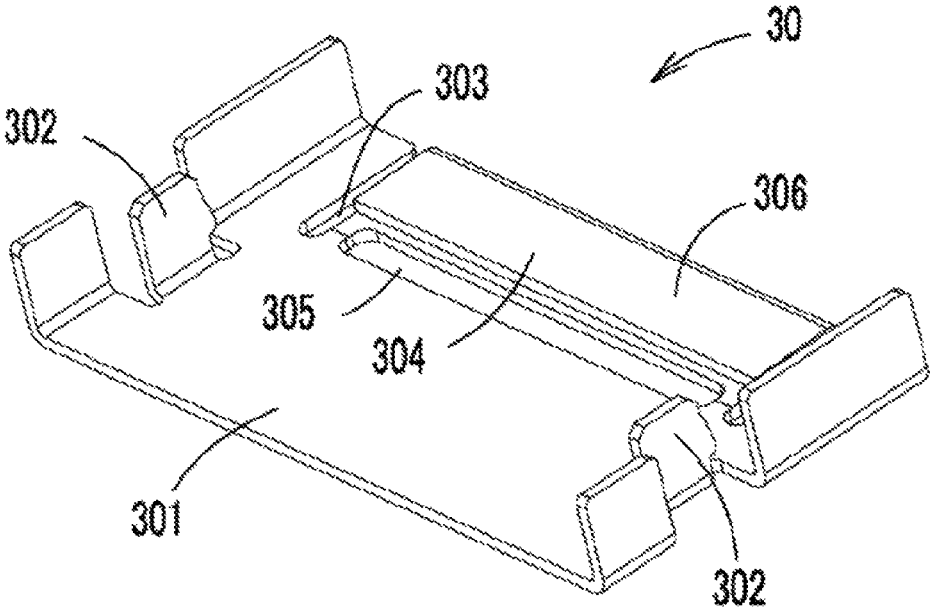
FIG. 4(B) is a perspective view of a shell as an embodiment of the invention viewing from a lower direction of an insertion port for a connection body.
Figure 5A:
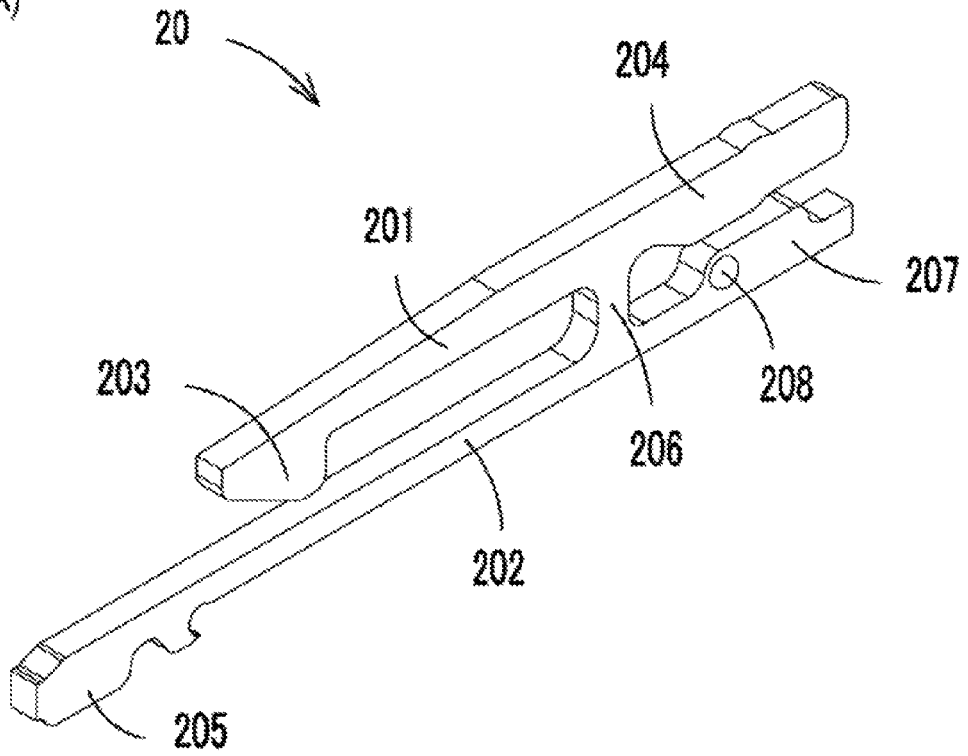
FIG. 5(A) is a perspective view of a tab as a lock member in a connector as an embodiment of the invention viewing from an insertion port for a connection body.
Figure 5B:
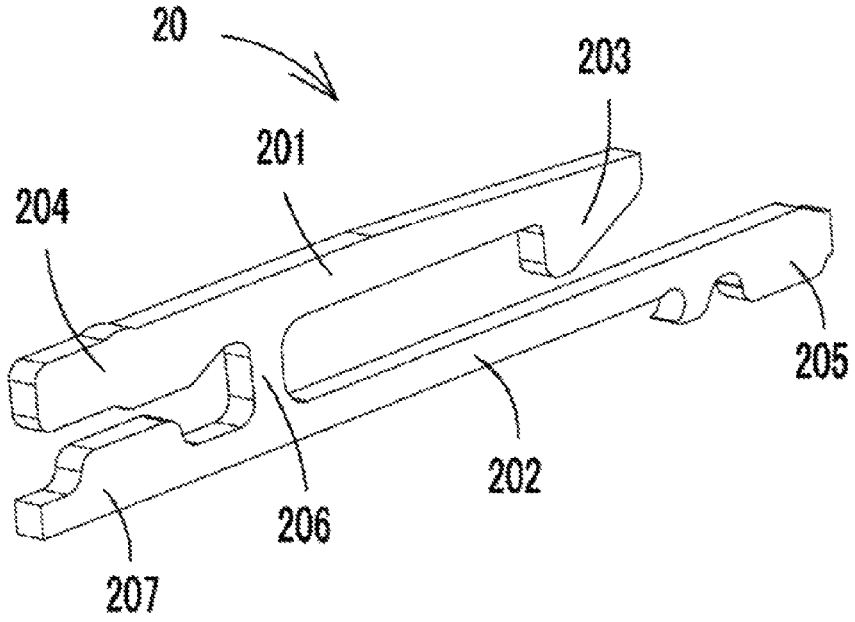
FIG. 5(B) is a perspective view of a tab as a lock member in a connector as an embodiment of the invention viewing from a direction opposing to an insertion port for a connection body.

As shown in FIG. 5, the tab 20 comprises at least a first piece 201 provided at one end side with an engaging portion 203 located opposite to the mounting face of the substrate and engaging with a locking portion 62 of the connection body and at the other end side with a pressure receiving portion 204 pushed by the shell 30, a second piece 202 provided at one end side or the other end side with another or third connecting portion 205 mounted onto the substrate, and a connecting portion 206 connecting an approximately central part of the first piece 201 to the other end or one end of the second piece 202. In this example, it is further provided with an extension portion 207 and has an inverted H-shaped form.

The tab 20 is designed so that when the connection body is detached, the pressure receiving portion 204 is pushed (acted) by the pushing portion 304 of the shell 30 to move the pressure receiving portion 304 toward the mounting face of the substrate and move the engaging portion 203 toward a side opposing to the mounting face of the substrate. It may be anything as long as the above movements can be attained. For example, only the first piece 201 may be moved by the principle of leverage, or T-shaped part between the first piece 201 and the connection portion 206 may be moved as a whole. By moving the engaging portion 203 in a direction opposite to the mounting face of the substrate is unfastened the engaging portion 203 from the locking portion 62 of the connection body. There are point of effort, pivot point and point of load in the principle of leverage, but the tab 20 has not a concept of point and means a certain range because it is integrally formed by a material having an elasticity. The pivot point is not a fixed point and may be moved by a force applied to the tab 20 to attain the above movement totally.

The engaging portion 203 is disposed in a position corresponding to the locking portion 62 of FPC 60 and has a structure that an inserting force is required in the insertion of FPC 60 when the pushing portion is not pushed, while a detaching force is needless or can be reduced by pushing the pushing portion 304 in the detaching of FPC 60.

The size and shape of the engaging portion 203 may be anything as long as it may be engaged with the locking portion 62 of FPC 60, and are properly designed so as to satisfy the required keeping force without causing fatal damage even in the insertion of FPC 60.

The third connection portion 205 is a portion mounted onto the substrate and is a surface mounting type (SMT: Surface Mount Technology) in this example, but may be a dip type (DIP: Dual In-line Package). The position of the third connecting portion 205 is properly designed from a position relationship to connecting portions of the required number of contacts in view of considering the mounting strength of the connector. In this example, there are two kinds of contacts (12, 14) and connecting portions (122, 142) of the contacts (12, 14) are arranged alternately to each other at a side of the insertion port 5 and at a side opposing thereto, so that the position of the connecting portion may be the side of the insertion port 5 or the opposite side thereof. In this example, it is the side of the insertion port 5. When the kind of the contacts is only one and the connecting portion thereof is the side of the insertion port 5, the third connecting portion 205 of the tab 20 is a side opposing to the insertion port 5, while when the third connecting portion is a side opposite to the insertion port 5, the third connecting portion 205 of the tab 20 is a side of the insertion port 5.

When the third connecting portion 205 is a side of the insertion port 5, the tab 20 is further desirable to have an extension portion 207 extending in a direction opposing to the insertion port 5 at a side opposite to the pressure receiving portion 204. The extension portion 207 is provided for restricting movement quantity when the pressure receiving portion 204 is pushed by the pushing portion 304 of the shell 30 to move the pressure receiving portion 204 toward the mounting face of the substrate. The shape and size of the extension portion 207 are properly designed by considering the function, strength, workability and so on.

When the third connecting portion 205 is a side opposing to the insertion port 5, the third connecting portion 205 possesses not only the purpose of the connection but also the function of restricting the movement likewise a function of the extension portion 207.

The two kinds of contacts (first contact segments 12 and second contact segments 14) are kept in the housing 16 alternately to each other for narrowing the pitch and increasing the density. The first contact segments 12 are inserted into the housing 16 from a side opposing to the insertion port 5, while the second contact segments 14 are inserted into the housing 16 from the side of the insertion port 5.

That is, the first connecting portion 122 of the first contact segments 12 are position in a side opposing to the insertion port 5, while the second connecting portions 142 of the second contact segments 14 are position in the side of the insertion port 5.

The first contact segment 12 will be described below. The first contact segment 12 is made from a metal and manufactured by a well-known pressing technique. As the material of the first contact segment 12 are mentioned brass, beryllium copper alloy, phosphor bronze, Corson alloy and so on because it is required to have a spring property, an electrical conductivity and the like.

Figure 6A:
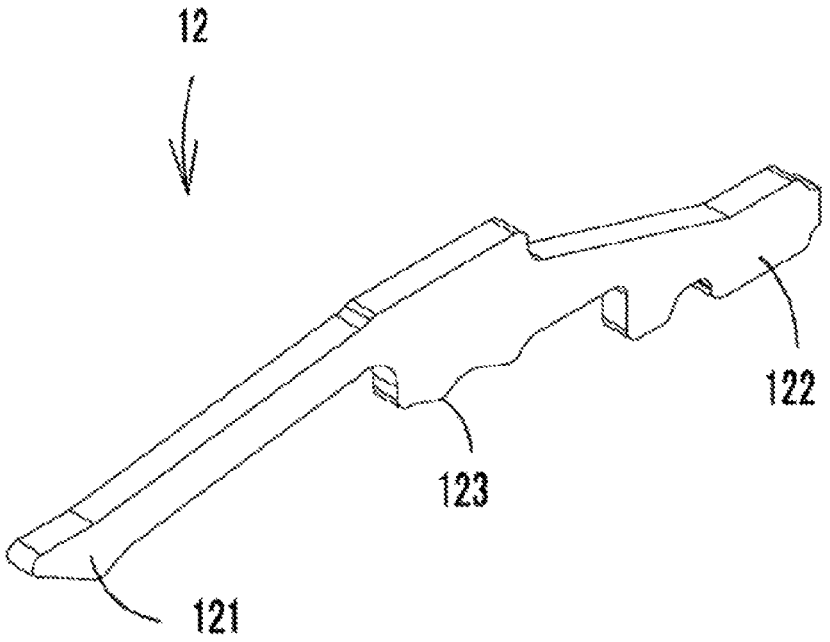
FIG. 6(A) is a perspective view of a first contact segment viewing from an insertion port for a connection body.
Figure 6B:
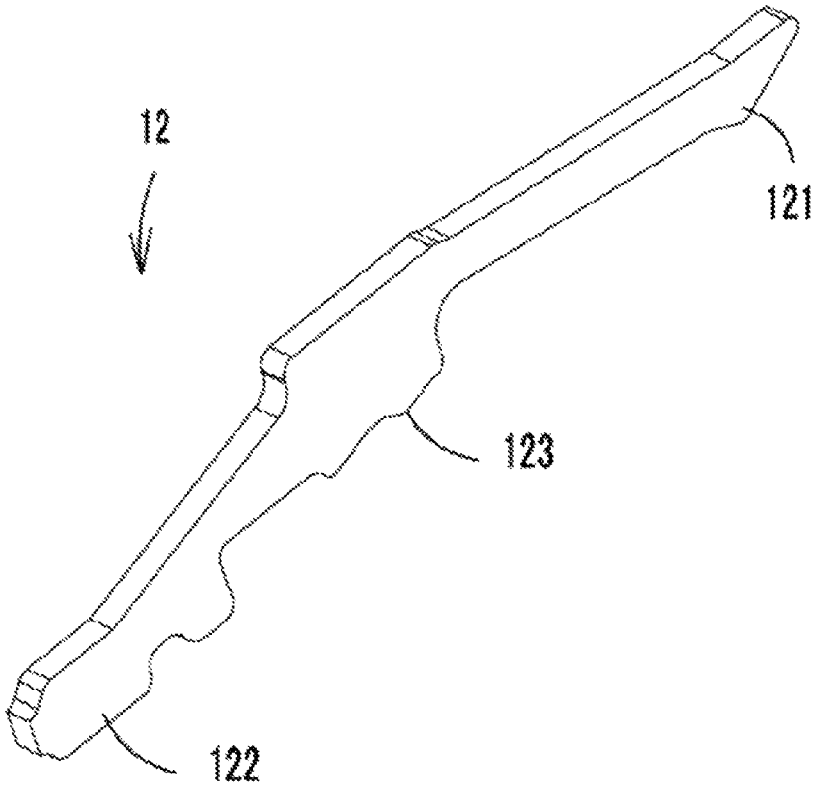
FIG. 6(B) is a perspective view of a first contact segment viewing from a direction opposing to an insertion port for a connection body.

As shown in FIG. 6, the first contact segment 12 is approximately linear and is provided at its end end side with a first contacting portion 121 contacting with FPC 60 and at the other end side with a first connecting portion 122 connecting to the substrate. The first contacting portion 121 is arranged so as to contact with the land 64 of FPC 60 at the side opposing to the mounting face of the substrate and protruded curvedly so as to facilitate the contacting. A gap between the first contacting portion 121 and the housing 16 located at a side opposite thereto (gap size between contact segments) is properly designed so as to attain sure connection (contacting) in the insertion of FPC 60 and provide a connection pressure. The contacting is attained at the side opposing to the mounting face of the substrate in this example. However, the contacting can be attained at a side of the mounting face of the substrate, or the contacting may be attained at both sides of the mounting face. In this case, the gap size is the same as above.

The first connecting portion 122 is a portion mounted onto the substrate and is a surface mounting type (SMT) in this example, but may be a dip type or a press fit type. It is properly designed by considering the specification, mounting density and so on. The first connecting portion 122 is arranged at a side opposing to the insertion port 5.

A first fixed portion 123 is provided at a side of the first connecting portion 122 and at a side of the mounting face of the substrate. The first fixed portion 123 is provided with a convex part and fixed to the housing 16 by press fitting. It may have any structure as long as it can be fixed or may have a structure (lance) by welding or hooking. The shape and size of the first fixed portion 123 are properly designed by considering the keeping force, downsizing of the connector, strength, workability and so on.

The second contact segment 14 will be described below. The second contact segment 14 is made from a metal and manufactured by a well-known pressing technique. As the material of the second contact segment 14 may be mentioned brass, beryllium copper alloy, phosphor bronze, Corson alloy and so on because it is required to have a spring property, an electrical conductivity and the like.

Figure 7A:
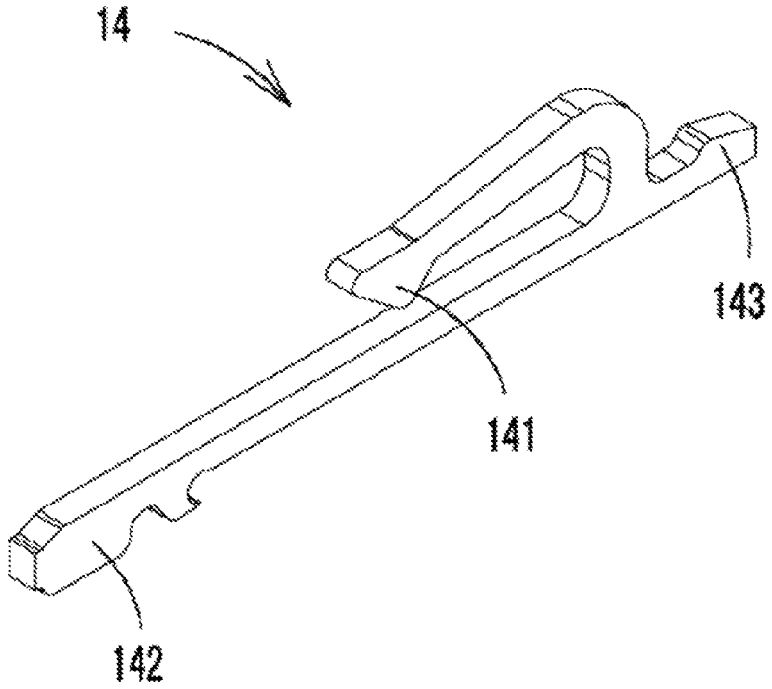
FIG. 7(A) is a perspective view of a second contact segment viewing from an insertion port for a connection body.
Figure 7B:
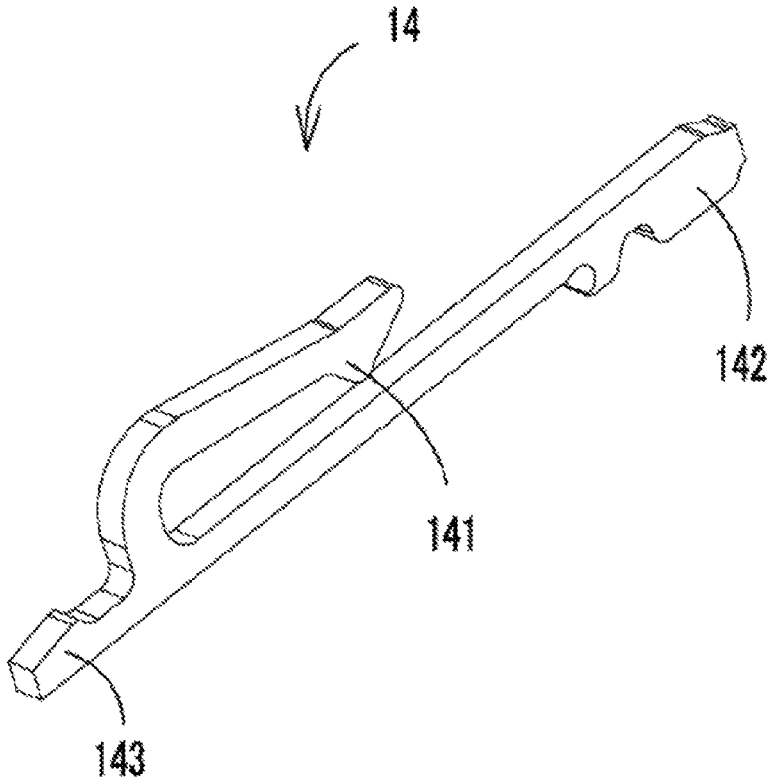
FIG. 7(B) is a perspective view of a first contact segment viewing from a direction opposing to an insertion port for a connection body.

As shown in FIG. 7, the second contact segment 14 is approximately inverted H-shaped form and is provided at its one end side with a second connecting portion 142 connecting to the substrate and at the other end side with a second fixed portion 143 keeping the housing 16 and further on its curved tip with a second contacting portion 141 contacting with FPC 60. The second contacting portion 141 is arranged so as to contact with the land 64 of FPC 60 at a side opposing to the mounting face of the substrate and protrude curvedly so as to facilitate the contacting. A gap between the second contacting portion 141 and the site of the second contact segment 14 (gap size between contact segments) is properly designed so as to attain sure connection (contacting) and provide a connection pressure in the insertion of FPC 60. It is contacted at a side opposing to the mounting face of the substrate in this example. Instead of the inverted H-shaped form, a protruding convex part can be formed between the second connecting portion 142 and the second fixed portion 143 so as to attain the contacting at the side of the mounting face of the substrate, or the contacting may be attained at both sides of the mounting face. In this case, the gap size is the same as above.

The second connecting portion 142 is a portion mounted onto the substrate and is a surface mounting type (SMT) in this example, buy may be a dip type or a press fitting type. It is properly designed by considering the specification, mounting density and so on. The second connecting portion 142 is arranged at the side of the insertion port 5.

The second fixed portion 143 is provided with a convex part and fixed to the housing 16 by press fitting. It may have any structure as long as it can be fixed or may have a structure (lance) by welding or hooking. The shape and size of the second fixed portion 143 are properly designed by considering the keeping force, downsizing of the connector, strength, workability and so on.

The first contact segments 12 and the second contact segments 14 are arranged alternately to each other by changing insertion directions of the contact segments 12, 14 into the housing 16 in this example. However, either first or second contact segments may be arranged.

Although the two kinds of the first contact segments 12 and the second contact segments 14 are arrange alternately to each other by changing the insertion direction into the housing 16, the two kinds of the contact segments may be inserted into the same insertion groove of the housing 16 and kept therein (not shown). The first contact segments have the same structure (approximately linear structure capable of contacting the first contacting portion with the land 64 of FPC 60 at a side opposing to the mounting face of the substrate and mounting the first connecting portion at a side opposing to the insertion port 5), while the second contact segments are approximately linear and have a structure capable of contacting the second contacting portion with the land of FPC 60 at a side of the mounting face of the substrate and mounting the second connecting portion at the side of the insertion port 5.

The housing 16 will be described below. The housing is made from an electrically insulating plastic and manufactured by a well-known injection molding technique. The material thereof is properly selected by considering dimensional stability, workability, cost and so on, but may include polyethylene terephthalate (PET), polyamide (66PA, 46PA), liquid crystal polymer (LCP), polycarbonate (PC) and synthetic materials thereof.

As shown in FIG. 3, the housing 16 is composed mainly of a main body portion 161 and a flange portion 162. The main body portion 161 is provided with an insertion port 5 inserting FPC 60. In the main body portion 161 are formed insertion grooves 163, 164 and insertion holes 165 extending in a direction from the side of the insertion port 5 to a side opposing thereto and keeping the required number of contacts 12, 14 and tabs 20. In the flange portion 162 is formed a fixed groove 166 keeping the fixed portion 302 of the shell 30.

The shape and size of the insertion port 5 are adapted to the shape and size of FPC 60 and may be anything as long as FPC 60 can be inserted and is properly designed by considering the workability, strength, downsizing of the connector and so on.

The insertion grooves keeping the contacts are first insertion groove segments 163 and second insertion groove segments 164 corresponding to the two kinds of contacts. Into the first insertion groove segment 163 is inserted the first contact segment 14 from the side opposing to the insertion port 5 and kept therein. Into the second insertion groove segment 164 is inserted the second contact segment 14 from the side of the insertion port 5 and kept therein. These groove segments are provided with a convex part, respectively, and fixed to the housing 16 by press fitting. The groove segment may be any structure as long as it can be fixed and may have a structure (lance) by welding or hooking.

The insertion holes 165 are formed at both ends in the array direction of the required number of contacts, respectively. The tab 20 is inserted thereinto from the side of the insertion port 5 and kept therein. In this example, the tab 20 is fixed to the housing 16 by press fitting, but they may be any structure as long as the tab can be fixed and may have a structure (lance) by welding or hooking.

The fixed groove 166 is a portion inserting and keeping the fixed piece 302 of the shell 30. The fixed piece 302 of the shell 30 is provided with an arrowhead portion and fixed to the housing 16 by press fitting, but may be any structure as long as the fixation can be attained and may have a structure (lance) by welding or hooking.

In the housing 16, it is desirable that grooves or holes 167 are formed at a side opposing to the mounting face of the substrate and at both ends in the vicinity of the flange portion 162 and in a position corresponding to the engaging portion 203 of the tab 20 in consideration of downsizing of the connector. The groove or hole 167 is an escape portion when the engaging portion 203 is moved toward the side opposing to the mounting face of the substrate. The shape and size of the groove or hole 167 are properly designed by considering the function, strength, workability, downsizing of the connector and so on.

Finally, the way of detaching FPC 60 will be described below. In the detaching of FPC 60, the pushing portion 304 of the shell 30 is pushed in a direction of the mounting face of the substrate with a finger or a jig and the pressure receiving portion 204 of the tab 20 is pushed by the pushing portion 304 of the shell 30, whereby the pressure receiving portion 204 is moved toward the side of the mounting face of the substrate and the engaging portion 203 of the tab 20 is moved toward a side opposing to the mounting face of the substrate to thereby unfasten the engaging portion 203 from the lock portion 62.

In the above embodiment, the first displacement is constructed with the slits 303 and 303, but is not limited to the slits 303, 303 as long as the side of the shell 30 opposite to the insertion port 5 can be elastically deformed by pushing with a finger, a jig or the like to push the pressure receiving portion 204 of the tab 20 as a lock member. For example, the first displacement means may be an elastically deformable thinned portion of the shell 30 formed at a side opposing to the insertion port 5. Also, the first displacement means may be a groove formed in the same position and range as the slits 303, 303.

INDUSTRIAL APPLICABILITY

The invention is utilized to a connector used in electronic devices such as mobile phones, notebook computers, digital cameras and the like, and more particularly it relates to a connector having a simple structure, which can be connected only by inserting FPC or FFC without increasing the number of parts and causing breakage in view of strength and damaging the operability and prevents the unfastening of FPC or FFC and can be easily detached and can make narrowing of a connector mounting space.

DESCRIPTION OF REFERENCE SYMBOLS

5 insertion port
10 connector
12 first contact segment
121 first contacting portion
122 first connecting portion
123 first fixed portion
14 second contact segment
141 second contacting portion
142 second connecting portion
143 second fixed portion
16 housing
161 main body portion
162 flange portion
163 first insertion groove segment
164 second insertion groove segment
165 insertion hole
166 fixed groove
167 groove or hole
20 housing
201 first piece
202 second piece
203 engaging portion
204 pressure receiving portion
205 third contacting portion
206 connection portion
207 extension portion
208 fixed portion
30 shell
301 main body
302 fixed piece
303 slit
304 pushing portion
305 hole
60 FPC
62 locking portion
64 land
66 pattern

What is claimed is:

1. A connector mounted onto a substrate and inserting a connection body with a locking portion from a direction substantially parallel to a mounting face of the substrate, which comprises a required number of contacts each having a contacting portion contacting with the connection body and a connecting portion mounted onto the substrate;

an electrical insulation housing for supporting the contacts and having an insertion port inserting the connection body;

a metallic shell covering the housing; and a lock member engaging with the locking portion, characterized in that the lock member comprises a first piece provided on an end side thereof with an engaging portion located at a side of the connection body opposite to the mounting face of the substrate and engaged with the locking portion and on the other end side with a pressure receiving portion pressed by the shell, a second piece provided on an end side or other end side with another connecting portion mounted onto the substrate, and a connection portion connecting an approximately middle portion of the first piece to an end or the other end of the second piece; and the shell comprises a pushing portion arranged at an opposite side of the insertion port and at a position of the shell corresponding to the pressure receiving portion, and a first displacement means facilitating an elastic deformation of the pressure receiving portion.

2. A connector according to claim 1, wherein the first displacement means is constructed with two slits disposed in the vicinity of both ends in an array pitch direction of the required number of contacts.

3. A connector according to claim 1, wherein the pressure receiving portion is moved toward a side of the mounting face of the substrate by pushing the pressure receiving portion of the lock member with the pushing portion of the shell in the detaching of the connection body, whereby the engaging portion of the lock member is moved toward a side opposite to the mounting face of the substrate to detach the engaging portion from the locking portion.

4. A connector according to claim 1, which further comprises a second displacement means facilitating the elastic deformation of the pushing portion.

5. A connector according to claim 2, wherein the slit is opened in a direction opposite to the insertion port.

6. A connector according to claim 4, wherein the second displacement means is constructed with an elongated hole extending in the array pitch direction of the required number of contacts.

7. A connector according to claim 1, wherein the pushing portion of the shell is provided with a reinforcing portion.

8. A connector according to claim 7, wherein a thickness of the pushing portion inclusive of the reinforcing portion is 0.12 mm-0.20 mm.

9. A connector according to claim 1, wherein the another connecting portion of the lock member is disposed at a side of the insertion port and the lock member is provided at a side opposing to the pressure receiving portion with an extension portion extended from the connection portion.

10. A connector according to claim 1, wherein the housing is provided with a groove or a hole at a side opposing to the mounting face of the substrate, in the vicinity of both ends in the array pitch direction and in a position corresponding to the engaging portion of the lock member.

11. A connector according to claim 1, wherein the contact includes one or both of a first contact segment that a first contacting portion as the contacting portion is disposed at a side of the insertion port and in a position contacting with a side of the connection body opposing to the mounting face of the substrate or a side of the mounting face of the substrate and a first connecting portion as the connecting portion is disposed at a side opposing to the insertion port or at a side of the insertion port and a second contact segment that a second contacting portion as the contacting portion is disposed at a side of the insertion port and in a position contacting with a side of the connection body at a side opposing to the mounting face of the substrate or at a side of the mounting face of the substrate and a second connecting portion as the connecting portion is disposed at a side of the insertion port or at a side opposing to the insertion port, and the first contact segment and the second contact segment are alternately arranged while changing insertion directions into the housing.

* * * * *